United States Patent [19]

Preus

[11] 4,124,981

[45] Nov. 14, 1978

[54] FLOTATION MEANS FOR BARRIER FOR WATER CARRIED POLLUTANTS AND METHOD OF MAKING SAME

[76] Inventor: Paul Preus, 21 Smith Rd., Toms River, N.J. 08753

[21] Appl. No.: 837,913

[22] Filed: Sep. 29, 1977

[51] Int. Cl.[2] ..... E02B 15/04

[52] U.S. Cl. ..... 405/66; 210/DIG. 25; 405/70; 405/72

[58] Field of Search ..... 61/1 F, 5; 156/69; 210/DIG. 25, DIG. 26, 242

[56] References Cited

U.S. PATENT DOCUMENTS

| | | | |
|---|---|---|---|
| 2,982,457 | 5/1961 | D'Alelio | 156/69 X |
| 3,547,719 | 12/1970 | Kasten | 156/69 |
| 3,554,823 | 1/1971 | Lee | 156/69 |
| 3,592,008 | 5/1969 | Trindle | 61/1 F |
| 3,686,869 | 8/1972 | Manuel | 61/1 F |
| 3,751,925 | 8/1973 | Thurman | 61/1 F |
| 3,845,633 | 11/1974 | Hammond | 61/1 F |

*Primary Examiner*—Dennis L. Taylor
*Attorney, Agent, or Firm*—Harold L. Stowell

[57] ABSTRACT

A barrier for water carried pollutants comprises a series of end to end connectable boom sections containing a flotable material; fluid impervious connectors for the ends of the boom sections; flexible draft members and associated connectors for maintaining the integrity of the boom if it becomes necessary to replace one or more of the boom sections, wherein the flotable material comprises a plurality of closed-cell foam, hollow, cylindrical blocks and end closure members for each end of each block.

3 Claims, 6 Drawing Figures

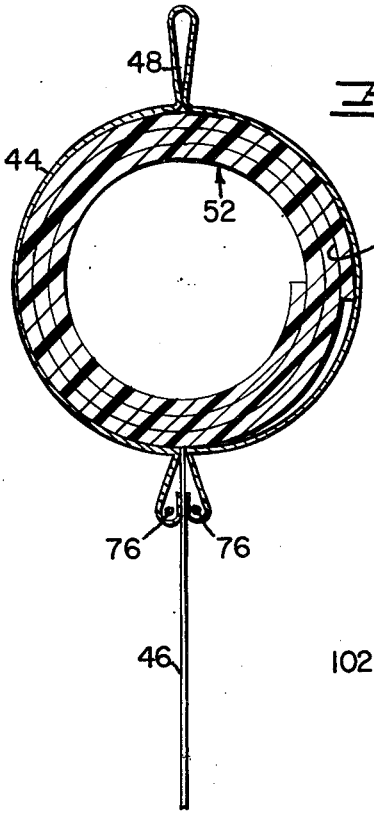
FIG. 3.
FIG. 4.
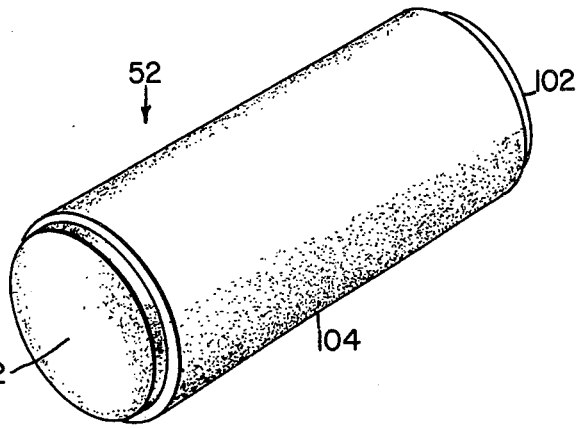
FIG. 5.
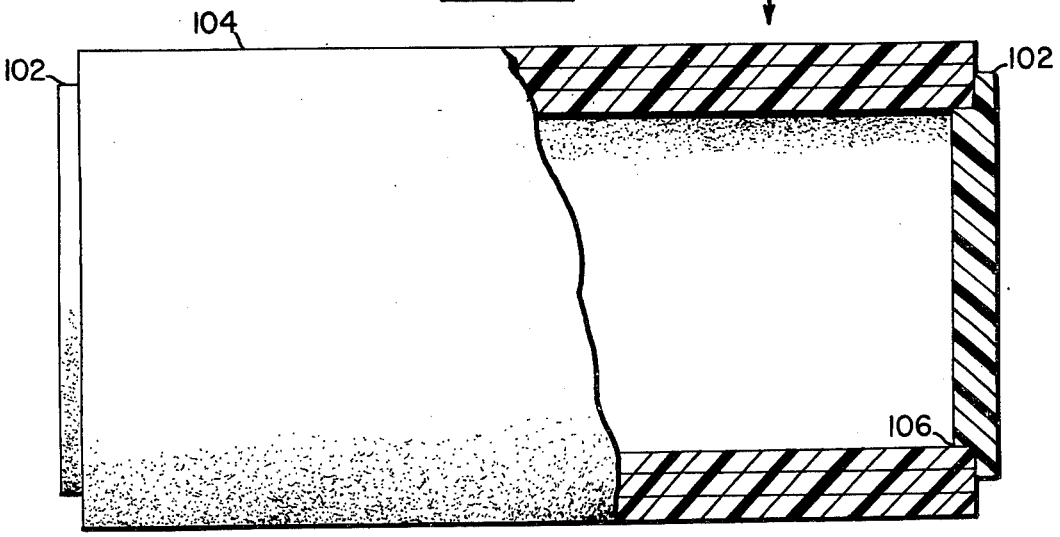

FLOTATION MEANS FOR BARRIER FOR WATER CARRIED POLLUTANTS AND METHOD OF MAKING SAME

CROSS-REFERENCE TO RELATED APPLICATIONS

Related subject material is disclosed in my U.S. Pat. 4,011,175 issued Mar. 8, 1977 which is a continuation of application Ser. No. 292,886 now U.S. Pat. No. 3,855,152 which is a division of application Ser. No. 83,640 filed Oct. 24, 1970, now abandoned.

Further related subject matter is disclosed in my U.S. Pat. Nos. 3,849,989; 3,667,235; 3,783,621 and 3,667,225 and others.

BACKGROUND OF THE INVENTION

Field of the Invention

Floating barriers, known generally as oil booms, have been found to have great utility in containing and controlling oil slicks and other water carried pollutants on and in bodies of water. The barriers include flotation elements having a depending liquid impervious skirt which, when deployed around or in a controlling position relative to the pollutant, provide means to contain or prevent the pollutant from spreading or moving into uncontaminated areas.

SUMMARY OF THE INVENTION

This invention is directed to a barrier for containing and controlling water carried pollutants, for example, oil oil wherein the entire barrier is composed of a series of boom sections which are connectable in end to end relationship with each of the boom sections containing a flotation material; wherein the flotable material comprises a plurality of closed-cell foam, hollow, cylindrical blocks and end closure members for each end of each block.

The invention is also directed to a method of making flotation units for pollutants controlling barriers comprising forming a closed-cell foam, hollow, cylindrical block by rolling and edge sealing a sheet of closed-cell foam material thereafter sealing end members to each end of each cylinder.

The invention will be more fully described in light of the accompanying drawing wherein like components throughout the figures are indicated by like numerals and wherein:

BRIEF DESCRIPTION OF THE DRAWING

FIG. 3 is an enlarged fragmentary sectional view of the structures shown in FIG. 2;

FIG. 4 is a perspective view of one flotation element;

FIG. 5 is an enlarged fragmentary view of the unit shown in FIG. 4; and

Figure 1:
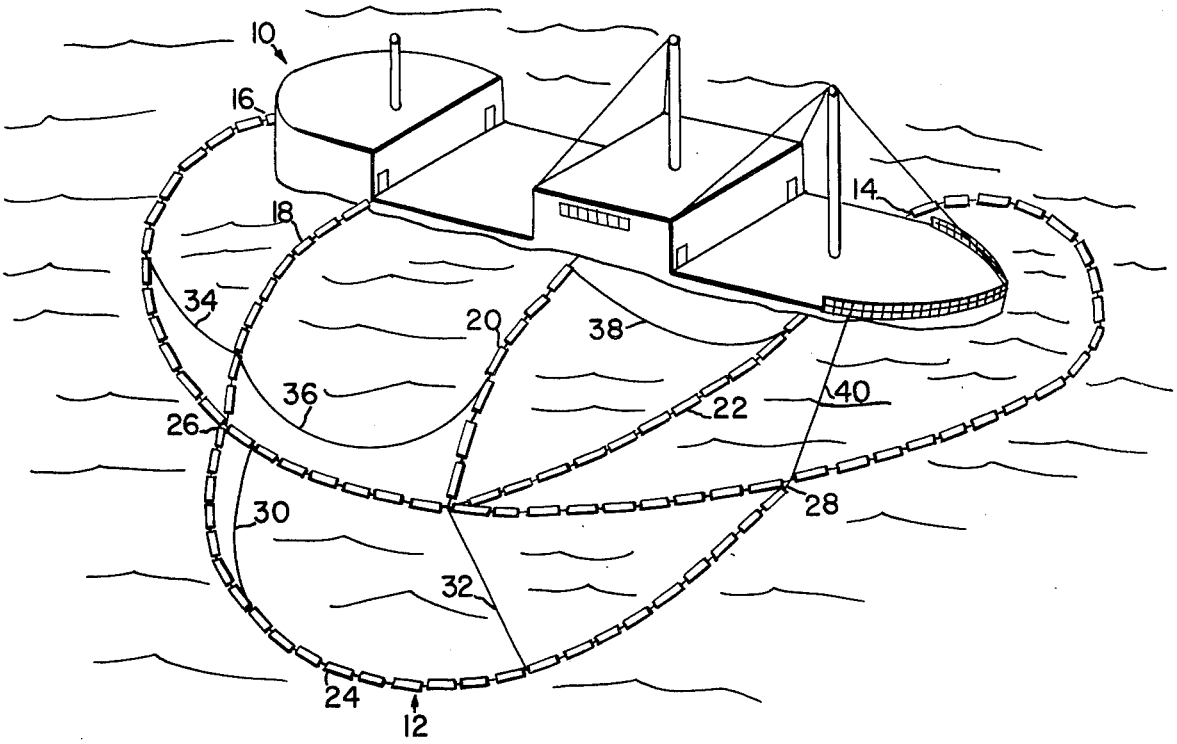
FIG. 1. is a somewhat diagrammatic perspective view of oil containing booms about a partially submerged vessel having oil leaking therefrom.
Figure 2:
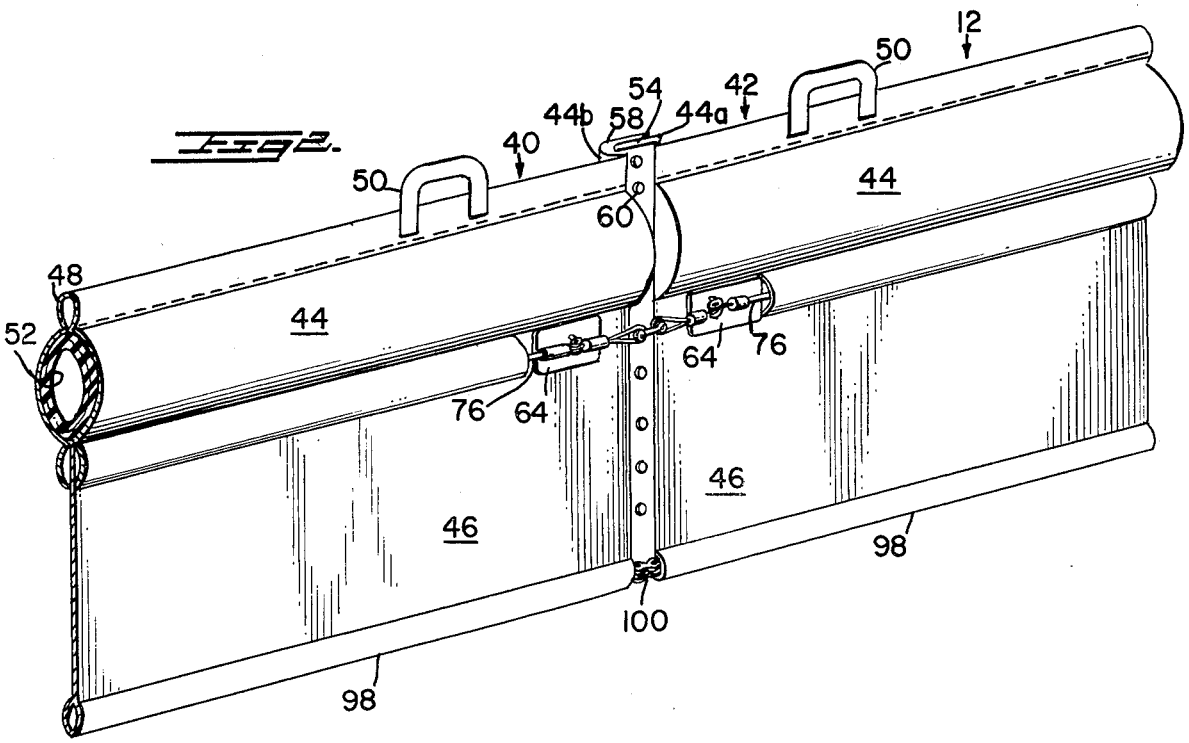
FIG. 2 is a perspective view of a portion of a pair of boom sections of the type wherein each of the floating booms includes flotation cells of the present invention.

Referring particularly to FIG. 1, 10 generally designates a partially submerged vessel having oil leaking therefrom and 12 designates a primary containment boom having ends 14 and 16 secured to portions of the vessel 10. The zone within the bounds of containment boom 12 is divided by other boom sections 18, 20 and 22 each having one end secured to a portion of the partially submerged vessel and the other end connected to the primary containment boom 12 at selected boom section joints.

FIG. 1 also illustrates the use of an additional containment boom 24 having ends 26 and 28 connected to section joints of the main containment boom 12. The supplemental containment boom 24 is placed downstream of the partially submerged vessel 10 and is also maintained in its illustrated configuration by cables 30 and 32. The cables 30 and 32 each have one end connected to the supplemental boom 24 and the other ends connected to the main containment boom 12.

FIG. 1 also illustrates the use of additional cables 34, 36, 38 and 40' which maintain the illustrated positioning of the primary boom 12 and the segmenting booms 18, 20 and 22.

Each of the stables and each of the supplemental booms are connected at joints between the ends of boom sections.

Each of the booms 12, 18, 20, 22 and 24 are composed of a plurality or series of boom sections, two of which are shown at 40 and 42 in FIGS. 2, 3, 5 and 6. Each of the boom sections comprises a generally tubular element 44 and a depending skirt 46. The tubular sections 44 may be provided with an upstanding fin 48 provided with hand grips 50 at spaced intervals there along.

The handles or hand grips 50 are useful in deploying and retrieving the boom sections. Further, the handles 40 are also very useful in storing the boom sections as the handles may be merely slipped over pegs spaced at least a pair of handles distance or multiples thereof. The hand grips have also been found to be helpful in cleaning the boom sections prior to reuse as the handles may be hung over hooks movably positioned above a scrub tank.

The upstanding fin 48 is useful in reducing slopover of the hydrocarbons being contained within the boom by wind, currents and wave action.

Within the tubular portions 44 is maintained flotatable material 52 of the present invention. One end of each boom section 42, designated 44*a* as an extended end portion 54 provided with a plurality of vertically aliened openings containing grommets. The opposite end of each boom section 40, generally designated 44*b* is provided with an extended flap portion 58, which extended flap portion receives a plurality of fasteners 60.

Just below the zone of the tubular portion 44, each side of each end of each boom section 40, 42, etc. is provided with a metal stiffening plate 64 one for each side.

Each plate 66 has welded thereto a pair of spaced connectors which receive a pair of cables 76.

By providing cables on each side of the boom, insures that regardless of the direction of currents, predominate wave action and/or winds, the cables will take the stress and relieve all stresses on the boom frabric. Further, with cables each side of the boom connected to the boom via the plates 66, etc. anchoring and shaping lines or cables such as illustrated at 30, 32, 34, 36, 38, and 40' may be connected to either or both sides of the boom and stresses on the boom due to such anchors or cables will be into the cables 76 rather than the boom fabric.

In order to provide for a stable type connection between the boom sections, the lower edge of each of the skirts 46 is turned up to form a pouch generally designated 98. The pouches 98 receive a ballast chain 100 and the ends or end links of each ballast chain 100 are connected by dual end shackles.

Referring now to FIGS. 3, 4, 5 and 6, the flotation units 52 are composed of a closed-cell foam, hollow, cylindrical block provided with end closure members 102. Any of the closed-cell foams of plastic, synthetic or natural rubber or the like can be employed in the construction of the units 52. However particularly useful results have been obtained when the unit 52 are made of Ethafoam manufactured and sold by Dow Chemical Company. Ethafoam foam plastic is a light weight, polyethelene foam that is about 30 times lighter, in weight than water, thereby having a substantial buoyancy. Polyethelene foam is flexible, having excellent resistance to chemicals and is an excellent energy absorber under impact with very low water absorption, low water vapor transmission and is available in a number of densities.

Figure 6:
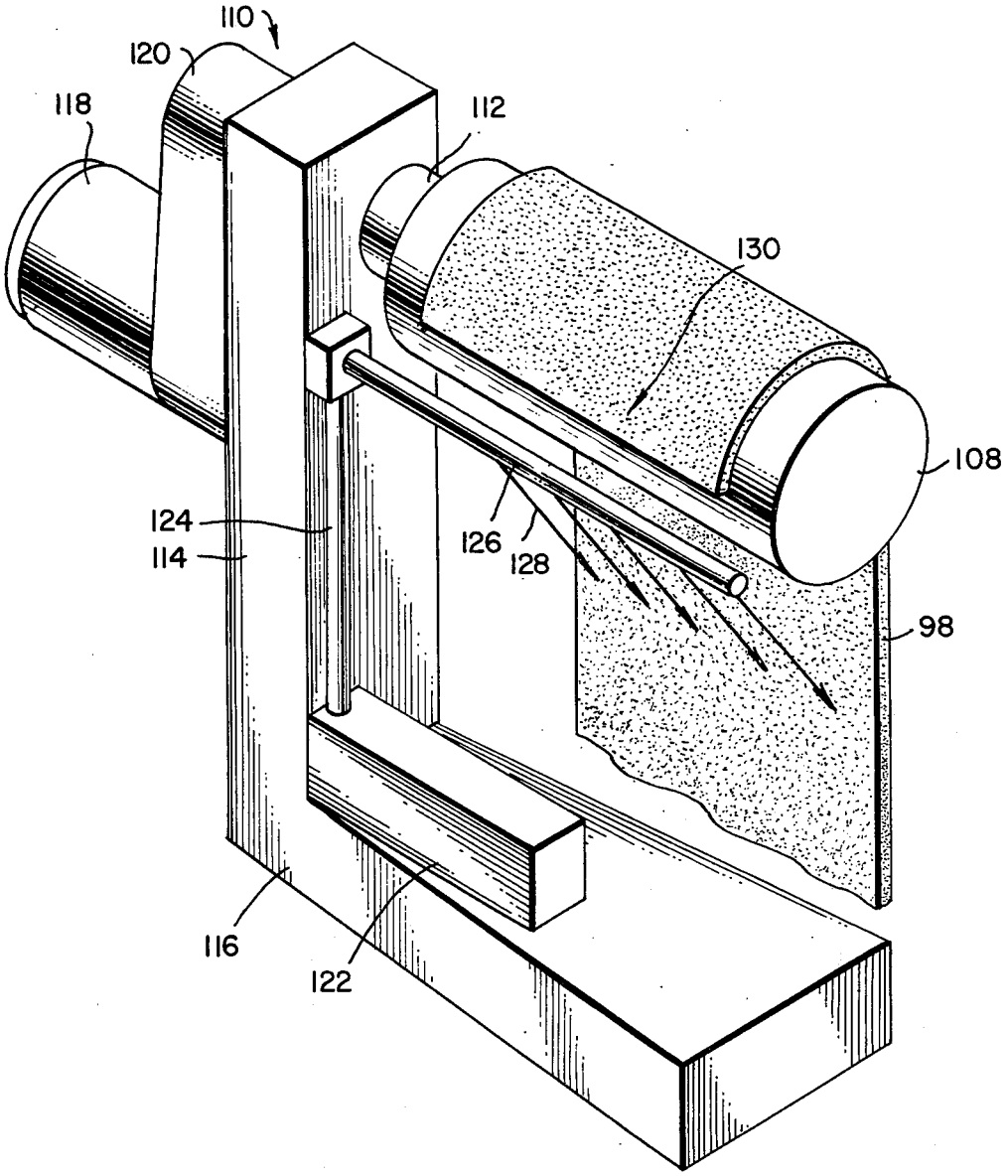
FIG. 6 is a perspective view of apparatus suitable for making flotation elements of the invention.

In order to reduce to a minimum the weight of the flotation element 52 and to reduce to a minimum the costs of materials, the barrel portion is formed by wrapping a sheet of, for example, Ethafoam 98 about a mandril 108, FIG. 6, and sealing the ends thereof. In the illustrated form of the invention, each flotation unit is formed by wrapping flat sheets of ½ inch thick by 24 inch wide Ethafoam, foam having a density of 2 lbs/cubic foot. The material is wrapped upon itself to provide a wall thickness of about 2 inches which, with the particular material, is very ample for a 12 inch diameter flotation cylinder. In order to increase the strength of the cylinder, the entire contacting surfaces of the sheet of closed-cell foam material are sealed with a suitable adhesive. Good results are obtained when using foam polyethelene that is heat sealed to itself. After formation of the barrel portion 104, the ends of each flotation element 52 are provided with water impervious end caps 102.

The end caps reduce the amount of foam plastic required in the manufacture of the flotation elements and thus the weight of the units it kept to a minimum, while the sealed air chambers maximize bouyancy of each unit.

In the illustrated form of the invention, the end caps 102 are also made of polyethelene closed-cell foam having a thickness of 1 inch and a density of about 9 lbs/cubic foot. Using higher density end caps insures high strength for the flotation units.

In the illustrated form of the invention, each end cap 102 is circular in plan and is provided with a cut-out portion 106 so that each end cap 102 is received partly within the internal barrel portion of the tubular elements 104 and a portion of each end cap overlaps the ends of the barrel portion as more clearly illustrated in FIG. 5 of the drawing. After formation of each end cap 102, suitable adhesives are applied to the surfaces which will contact the barrel portion 104 or the end caps are permanently heat sealed in the illustrated position.

Referring particularly to FIG. 6 of the drawing, there is illustrated apparatus suitable for carrying the process of the present invention. The flotation unit forming apparatus generally designated 110 comprises the mandril 108 having a diameter equivalent to the desired inside diameter of the flotation element to be produced on the machine. In a commercial aspect of the apparatus 110, the mandril 108 would be releasably secured to shaft 112 so that varies sizes of mandril 108 might be used on the same apparatus. The shaft 112 is supported on an upright 114 formed with a base or platform 116. The upright 114 also carries an electric motor 118 gear connected to the shaft 112 so that the speed of rotation of the mandril 108 is in the order of, for example, 2 to 4 rpms.

In the drawing, the gear train is not illustrated, but is mounted within the housing 120.

The unit also has heat sealing means 130 which includes an air heater generally designated 122 provided with an outlet duct 124 connected to a hot air header 126 having a plurality of outlet openings 128. The position of the header 126 and the direction of the outlet openings 128 are so selected that hot air is directed to the inner surface of the heat sealable plastic sheet 98 after the first layer of foam is wrapped about the mandril 108 whereby, when the sheet is wrapped upon itself, a substantial bond is obtained.

Using as the heat sealable plastic a polyethelene, an outlet temperature in the neighborhood of from about 125° to about 200° Fahrenheit has been found to be satisfactory.

While the specific example illustrates heat sealing, adhesive sealing is within the scope of the present invention.

In the example, hereinabove illustrated, the outer diameter of the barrel portion 104 is 12 inches. Where smaller diameter flotation elements are employed, sufficient strength would be provided by less overlapping and wrapping and, where larger say, for example, 24 or 36 inch diameter elements are desired, to provide the necessary strength using Ethafoam, wall thicknesses in the neighborhood of, for example, 3 to 4 inches would be preferable.

From the foregoing it will be seen that not only is the flotation element made from a material having, for example, about thirty times less weight than water, a portion of the entire flotation ability of the units comprises air within the hollow cylindrical elements thus vastly improving the buoyancy of the unit and the buoyancy of the containment boom having such units employed therein.

Other foam plastics suitable for use in the present invention are: cellulose acetate, epoxies, phenolformaldehyde, polystyrene, silicones, urea-formaldehyde, urethanes and vinyls.

It has been found that the boom sections 40–42 (FIG. 2), the hollow cylindrical elements thus vastly improving the buoyancy of the unit and the buoyancy of the containment boom having such units employed therein.

Other foam plastics suitable for use in the present invention are: cellulose acetate, epoxies, phenolformaldehyde, polystyrene, silicones, urea-formaldehyde, urethanes and vinyls.

It has been found that the boom sections 40–42 (FIG. 2), each having a length of about 50 feet and a diameter of about 12 inches, provides very satisfactory results. However, the length of each section may be from 2 feet to 100 feet and the diameter of each tubular section may be from 8 inches to as much as 36 inches. When the boom sections each include a depending skirt, such as skirt 46, a skirt length of about 24–30 inches is satisfactory for open water containment and will prevent underflow of oil in low and moderate water currents and skirt lengths of from 6 inches to more than 36 inches have been found to be useful.

Throughout the specification and in the drawings, the invention has been described as being deployed with a substantial freeboard; however, it will be recognized that in some cases the barrier is below the surface of the water with, for example, the lower edge of the skirt on or adjacent to the bottom of the water body. Further, two or more barrier units may be assembled in stacked superimposed relation.

One of the additional advantages of the illustrated form of construction is that, if the skirt and/or tubular sleeve become worn or torn, the hardwear such as the cables 76; the connectors 80, etc., chain 100, etc. and the flotation unit 52 may be reused with a new fabric sleeve and skirt.

The capability of reuse of the hardware materially reduces the expense of maintaining serviceable booms. In fact, it has been found that in some instances it is less expensive to refabric old hardware than it is to clean used boom sections used on dirty oil spills.

What has been set forth above is intended as exemplary of the present invention to enable those skilled in the art to practice the invention and what is new and therefore desired to be protected by Letters Patent of the United States is.

I claim:

1. A barrier for containing and controlling water carried pollutants comprising a series of boom sections, each boom section comprising a generally tubular portion and a skirt portion, each of the tubular portions containing a flotation material, and means connecting the boom sections in end-to-end relationship, characterized in that the flotation material comprises a plurality of hollow, cylindrical blocks, each of said blocks formed of a plurality of layers of closed-cell foam plastic material, end closure members for each end of each cylindrical block, and adhesive means maintaining the integrity of the layers of the cylindrical blocks and securing the end closure members to the ends of the cylindrical blocks.

2. The invention defined in claim 1 wherein the cylindrical blocks are formed from low density foam plastic and the end blocks are formed from a higher density foam plastic.

3. The invention defined in claim 2 wherein the foam plastic comprises closed cell-foam polyethelene.

* * * * *